US005892482A

United States Patent [19]

Coleman, Jr. et al.

[11] Patent Number: 5,892,482

[45] Date of Patent: Apr. 6, 1999

[54] ANTENNA MUTUAL COUPLING NEUTRALIZER

[75] Inventors: William E. Coleman, Jr., Clearwater; Ray B. Jones, Seminole, both of Fla.

[73] Assignee: Raytheon Company, Lexington, Mass.

[21] Appl. No.: 761,130

[22] Filed: Dec. 6, 1996

[51] Int. Cl.[6] ..... H01Q 1/38

[52] U.S. Cl. ..... 343/700 MS; 343/853

[58] Field of Search ..... 343/700 MS, 850, 343/853, 860, 872; 455/63; H01Q 1/38

[56] References Cited

U.S. PATENT DOCUMENTS

| | | | |
|---|---|---|---|
| 3,339,205 | 8/1967 | Smitka | 343/749 |
| 4,464,663 | 8/1984 | Lalezari et al. | 343/700 MS |
| 4,506,148 | 3/1985 | Berthold | 235/380 |
| 4,644,360 | 2/1987 | Mead et al. | 343/700 MS |
| 4,728,962 | 3/1988 | Kitsuda et al. | 343/700 MS |
| 5,006,859 | 4/1991 | Wong et al. | 343/700 MS |
| 5,045,862 | 9/1991 | Alden et al. | 343/700 MS |
| 5,241,322 | 8/1993 | Gegan | 343/700 MS |
| 5,561,435 | 10/1996 | Nalbandian | 343/700 MS |
| 5,572,222 | 11/1996 | Mailandt et al. | 343/700 MS |
| 5,574,978 | 11/1996 | Talwar et al. | 455/63 |

FOREIGN PATENT DOCUMENTS

| | | | |
|---|---|---|---|
| 0059607 | 4/1983 | Japan | 343/700 MS |

*Primary Examiner*—Don Wong
*Assistant Examiner*—Tan Ho
*Attorney, Agent, or Firm*—Baker & Botts, L.L.P.

[57] ABSTRACT

A mutual coupling neutralizer for neutralizing adverse mutual coupling between a pair of patch antennas for mobile communication system. The coupling neutralizer includes a first and second capacitor each having a first end and a second end, where the first ends are coupled to a respective patch antenna. The neutralizer further includes a high impedance transmission line connected to the second ends of the capacitors. The transmission line and capacitors are sized and configured to neutralize adverse mutual coupling between the pair of patch antennas over a predetermined frequency band. The neutralization of mutual coupling is achieved by extracting a signal present at one patch antenna and injecting the signal at the other patch antenna at a substantially equal amplitude and opposite in phase.

13 Claims, 7 Drawing Sheets

ANTENNA MUTUAL COUPLING NEUTRALIZER

TECHNICAL FIELD

The present invention relates generally to a coupling neutralizer and, more particularly, to a coupling neutralizer for substantially neutralizing mutual coupling between patch antennas used in a mobile communication system.

BACKGROUND OF THE INVENTION

Conventional cellular and new personal communications systems (PCS) are currently enjoying increasing demand throughout the United States and the world. A majority of urban and suburban areas have at least one communication system currently in use or planned to be installed. The large size of conventional cellular antennas make it difficult to find suitable sites for placement, especially in metropolitan areas.

The large size of a cellular antenna is due in part to several requirements for a mobile communication system. First, the antenna generally must be capable of simultaneously transmitting and receiving radio frequency signals. Secondly, both the receiving and transmitting antennas must be, in most cases, omnidirectional, meaning that the antenna is capable of receiving and transmitting in all horizontal directions. Finally, the antennas must have a high gain or large power density in a preferred direction of radiation.

Presently, cellular antennas consist of arrays of patch antennas that transmit and receive electromagnetic radiation. Patch antennas are particularly suitable for use in mobile communication systems because of their size. The size of a cellular antenna is further reduced by physically locating the patch antennas close to one another. However, patch antennas interact with one another resulting in mutual coupling that adversely effects the performance of the communication system.

Accordingly, there is a need for a mutual coupling neutralizer to substantially neutralize mutual coupling between patch antennas. There is also a requirement to provide smaller cellular antennas without sacrificing performance. These and other needs are satisfied by the mutual coupling neutralizer of the present invention.

SUMMARY OF THE INVENTION

The present invention is a mutual coupling neutralizer for neutralizing adverse mutual coupling between pairs of patch antennas used in a mobile communication system. The mutual coupling neutralizer includes a first and second capacitor each having a first end and a second end, where the first end of each tab is coupled to a respective patch antenna. The neutralizer further includes a high impedance transmission line connected to the second ends of the capacitors. The transmission line and capacitors are sized and configured to neutralize adverse mutual coupling between the pair of patch antennas over a predetermined frequency band. The neutralization of mutual coupling is achieved by extracting a signal present at one patch antenna and injecting the signal at the other patch antenna at a substantially equal amplitude and opposite in phase.

According to the present invention, there is provided a mutual coupling neutralizer that substantially neutralizes mutual coupling in cellular antennas.

Also in accordance with the present invention there is provided a mutual coupling neutralizer relatively simple to manufacture and easy to install.

Further in accordance with the present invention there is provided a mutual coupling neutralizer that enables construction of smaller cellular antennas by locating patch antennas physically closer to one another.

BRIEF DESCRIPTION OF THE DRAWINGS

A more complete understanding of the invention may be had by reference to the following Detailed Description when taken in conjunction with the accompanying Drawings wherein.

DETAILED DESCRIPTION OF THE DRAWINGS

Figure 1:
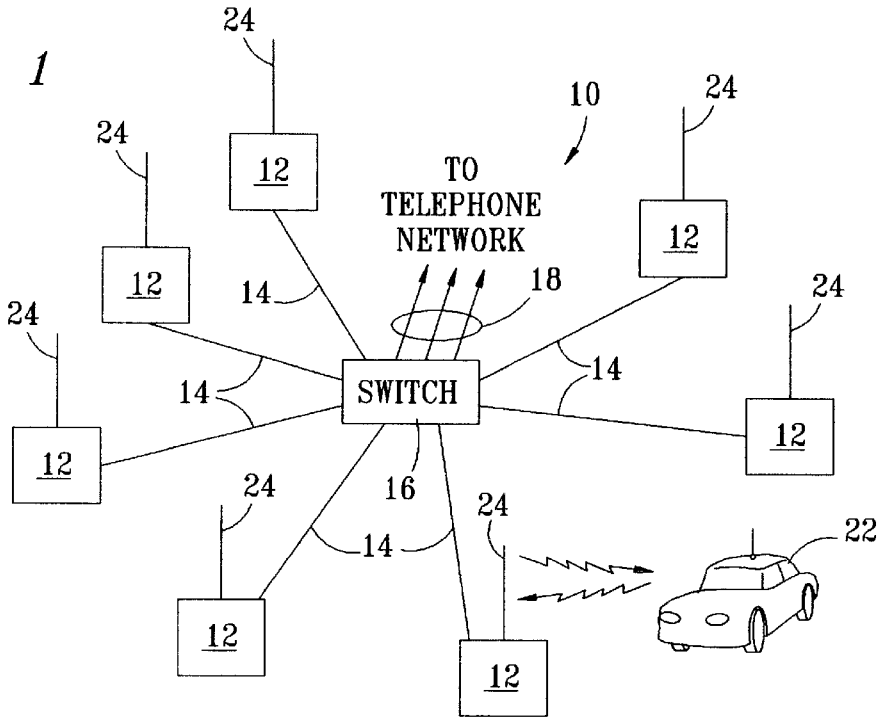
FIG. 1 is a schematic representation of a conventional land-based mobile communication system.

Referring to the Drawings, wherein like numerals represent like parts throughout the several views, there is disclosed a land-based mobile communication system 10 incorporating patch antennas having a mutual coupling neutralizer in accordance with the present invention.

Although preferred embodiments of a mutual coupling neutralizer associated with patch antennas are discussed herein, those skilled in the art will appreciate that such preferred embodiments are only a few of many utilizing the principles of the present invention. Accordingly, the mutual coupling neutralizers described should not be construed in a limiting manner.

Referring to FIG. 1, there is a schematic illustrating the land-based mobile communication system 10 that is well-known in the art and intended to be representative of all such systems. The communication system 10 includes multiple base stations 12 linked by a land-line 14 to a mobile communications switching office 16. The mobile communications switching office 16 connects with a local telephone system via trunk lines 18. Each base station 12 includes an antenna 24 connected to a radio frequency transmitter and receiver (not shown). The base station 12 simultaneously broadcasts and receives radio frequency signals over preassigned channels within a given frequency band.

Communication between the base station 12 and a mobile radio frequency transmitter and receiver, such as a mobile telephone carried in an automobile 22, is full duplex. The antenna 24 generally broadcasts and receives signals in all directions of azimuth.

Figure 2:
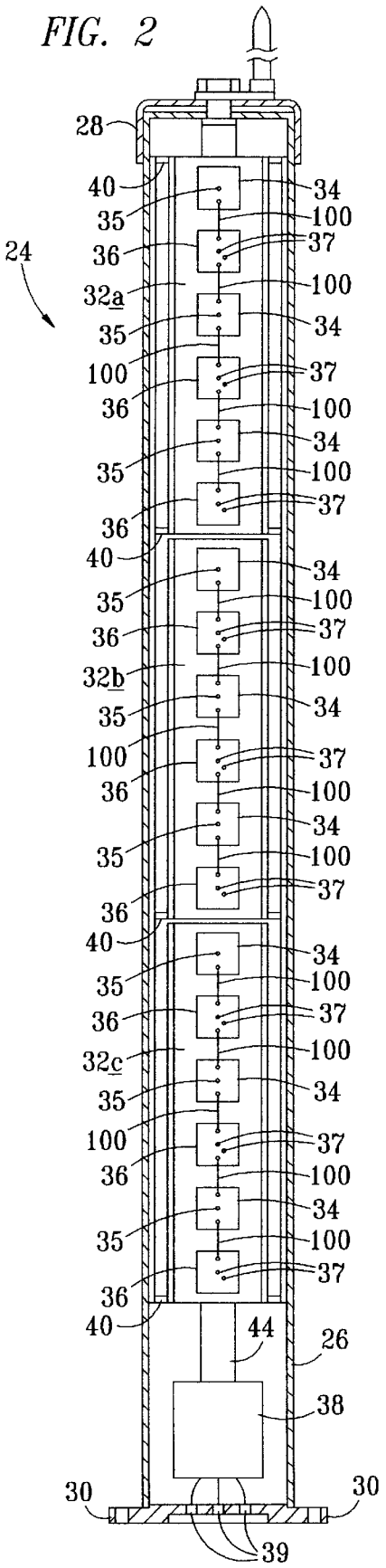
FIG. 2 illustrates an antenna for the communication system of FIG. 1 with a side portion of a radome cut away exposing mutual coupling neutralizer connected to adjacent patch antennas.

Referring to FIG. 2, there is illustrated the antenna 24 suitable for use in the mobile communication system 10 or other systems. The antenna 24 is enclosed by a substantially rigid, cylindrically-shaped radome 26 formed of a dielectric material. Enclosing the top of the radome 26 is a removable cap 28 for sealing the radome top and providing access to elements located inside the radome. A mounting base 30 for attaching the antenna 24 to a supporting structure is connected to and seals a bottom of the radome 26.

A flat or planar antenna panel 32 is revealed when a front portion of the radome 26 is cut-away. The antenna panel 32 includes three sections 32*a*, 32*b* and 32*c* of a dielectric material, the three sections are arranged end-to-end. On one surface of the three dielectric panels are etched, in a conventional manner, nine transmit patch antennas 34 and nine receive patch antennas 36 forming, respectively, a linear transmit array and linear receive array. The transmit patch antennas 34 are interleaved or alternated with the receive patch antennas 36 and between each pair a mutual coupling neutralizer 100 is positioned. A central pole or mast 44 supports the antenna panels 32*a*, 32*b* and 32*c*, and the radome 26 in a vertical position.

The antenna panels 32*a*, 32*b* and 32*c* each have a layer of metal (not visible) that forms a ground plane. Each transmit patch antenna 34 is fed signals through a back of the antenna panel 32 using a feed probe attached to a conventional coaxial connector (not shown). The tip 35 of each feed probe connector is connected to the transmit patch antenna 34.

Each receive patch antenna 36 is dual linearly polarized by feeding the receive patch antenna from the rear at two points, orthogonal to each other with respect to the center of the receive patch antenna. Alternately, the transmit patch antennas 34 and receive patch antennas 36 are fed by microstrip lines deposited on a layer of the antenna panels 32*a*, 32*b* and 32*c*.

The connectors of the transmit patch antenna 34 are connected by coaxial cable to a first power splitter to combine the signals from all of the transmit patch antennas 34 into a single signal for transmission to a radio receiver. In a similar manner, vertical polarization connectors from each receive patch antenna 36 are connected to a second power splitter, and horizontal polarization connectors are connected to a third power splitter. For simplicity, the three power splitters are schematically represented by box 38, and coaxial cables connecting each patch antenna 34 and 36 to the respective power splitter are omitted. A group of three cables 39, one for the transmit array and two for the receive array, extend through the mounting base 30 for connection to cables from the transmitters and receivers of the base station 12.

Figure 3:
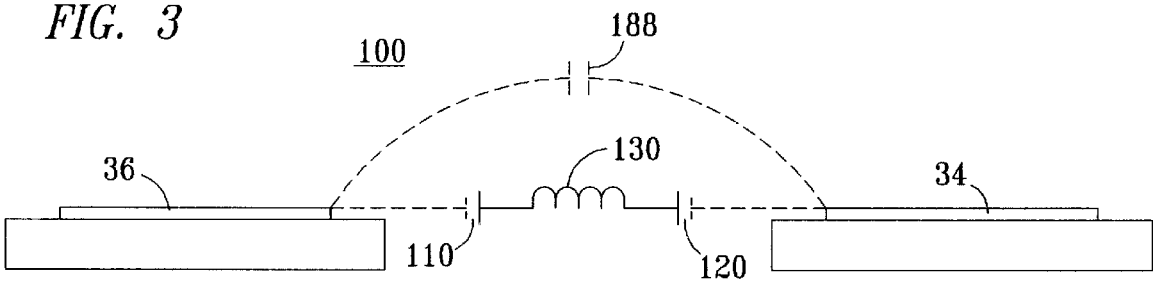
FIG. 3 is a representation of an electrical circuit for a mutual coupling neutralizer located between a pair of patch antennas.

Referring to FIG. 3, there is illustrated an electrical representation of a mutual coupling neutralizer 100 positioned between the transmit patch antenna 34 and the receive patch antenna 36. The coupling neutralizer 100 functions as a low-Q resonant circuit, and is electrically represented by a first capacitor 110, a second capacitor 120 and a high impedance transmission line or impedance element 130 all connected in series. The first capacitor 110 and the receive patch antenna 36 are interconnected, and the second capacitor 120 and the transmit patch antenna 34 are interconnected. The impedance element 130 is connected between the first capacitor 110 and the second capacitor 120. Also illustrated is stray capacitance 118 that exists between the patch antennas 34 and 36 regardless of whether a mutual coupling neutralizer 100 is installed.

Figure 4:
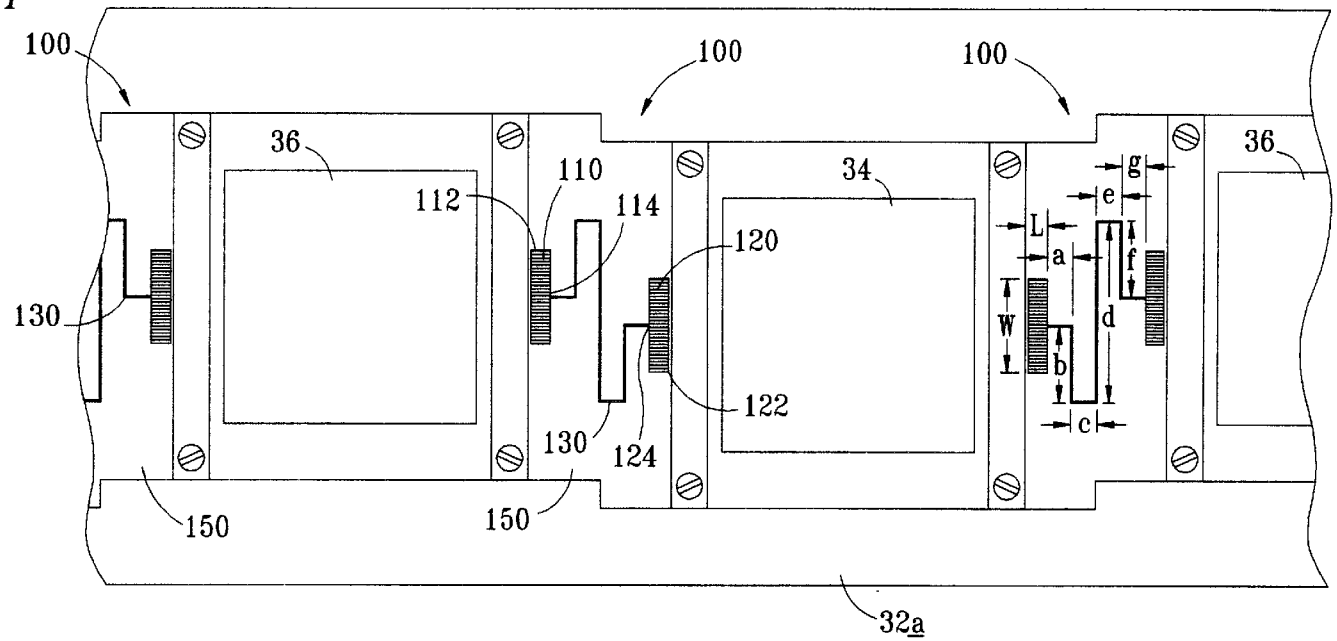
FIG. 4 is a top view of a mutual coupling neutralizer incorporated on a printed circuit board and connected to adjacent patch antennas.
Figure 5:
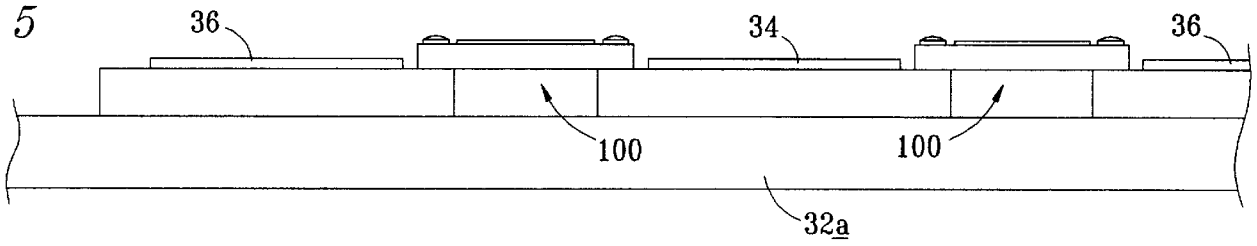
FIG. 5 is a side view of FIG. 4 illustrating mutual coupling neutralizers attached to adjacent patch antennas.

Referring to FIGS. 4 and 5, there is illustrated the mutual coupling neutralizer 100 implemented on an insulated mounting base or printed circuit board 150. The coupling neutralizer 100 includes the first capacitor 110, the second capacitor 120 and the high impedance transmission line or impedance element 130. The first capacitor 110 has a first end 112 connected to the receive patch antenna 36 and a second end 114 connected to the high impedance transmission line 130. The second capacitor 120 has a first end 122 connected to the transmit patch antenna 34, and a second end 124 connected to the end of the transmission line 130.

The first capacitor 110, the second capacitor 120 and the transmission line 130 are etched foil patterns on substrates of the printed circuit board or insulated mounting base 150. When installed in the radome 26, the printed circuit board 150 may have the etched foil patterns facing toward or away from the patch antennas 34 and 36, refer to FIG. 5. The etched foil patterns are sized to neutralize adverse mutual coupling between a pair of patch antennas 34 and 36 over a predetermined frequency band. Reduced mutual coupling is achieved by extracting a signal present at one patch antenna 34 or 36 and injecting the signal at the other patch antenna 36 or 34 at a substantially equal amplitude and opposite in phase.

A coupling neutralizer 100 has been constructed in accordance with the dimensions listed in a table below. The dimensions are representative of the preferred embodiment operating at 836 MHz; however, other dimensions are permissible depending on the application. The table below sets forth the dimensions (inches) of the coupling neutralizer, refer to FIG. 4 for corresponding segments.

| Segment | Dimension | Seqment | Dimension |
|---|---|---|---|
| W | 0.65 | L | 0.35 |
| a | 0.246 | b | 0.567 |
| c | 0.359 | d | 1.479 |
| e | 0.433 | f | 0.450 |
| g | 0.365 | | |

The segments a–g have a uniform width of 0.115" and a combined length of approximately one-quarter wavelength.

Figure 6:
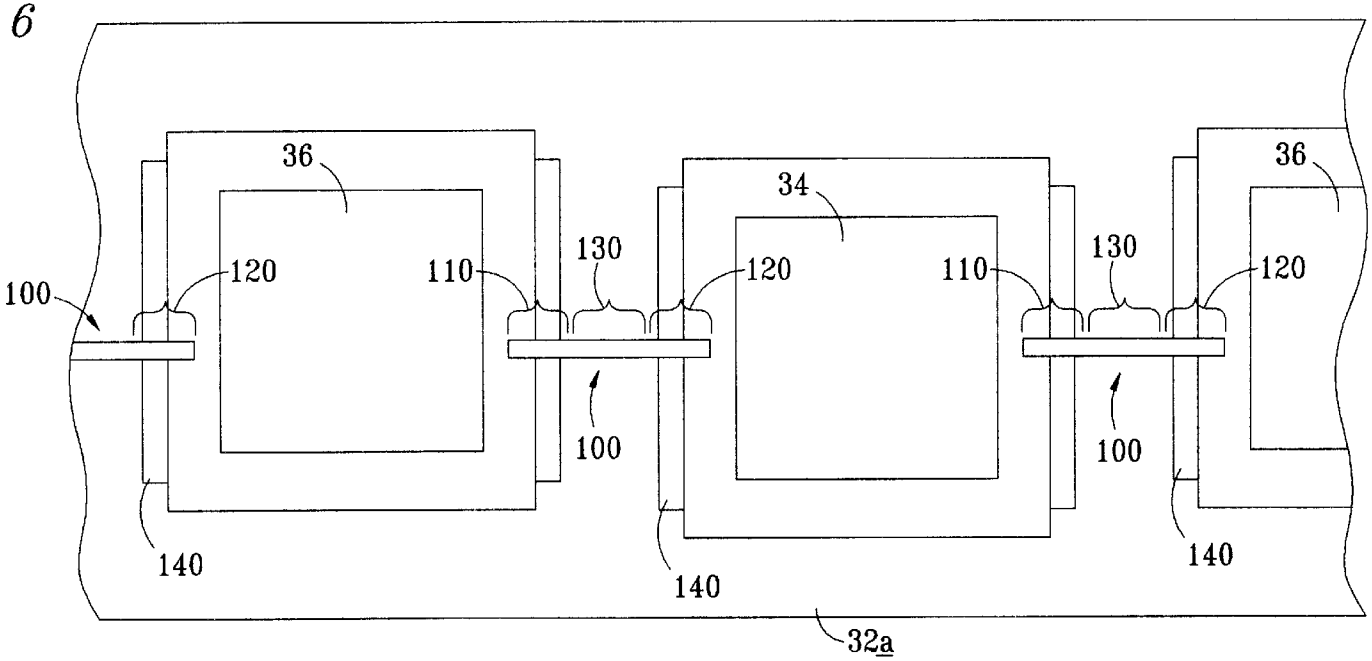
FIG. 6 is a top view of mutual coupling neutralizers incorporated into conductors, where each conductor forms an arc substantially perpendicular to the adjacent pair of patch antennas.
Figure 7:
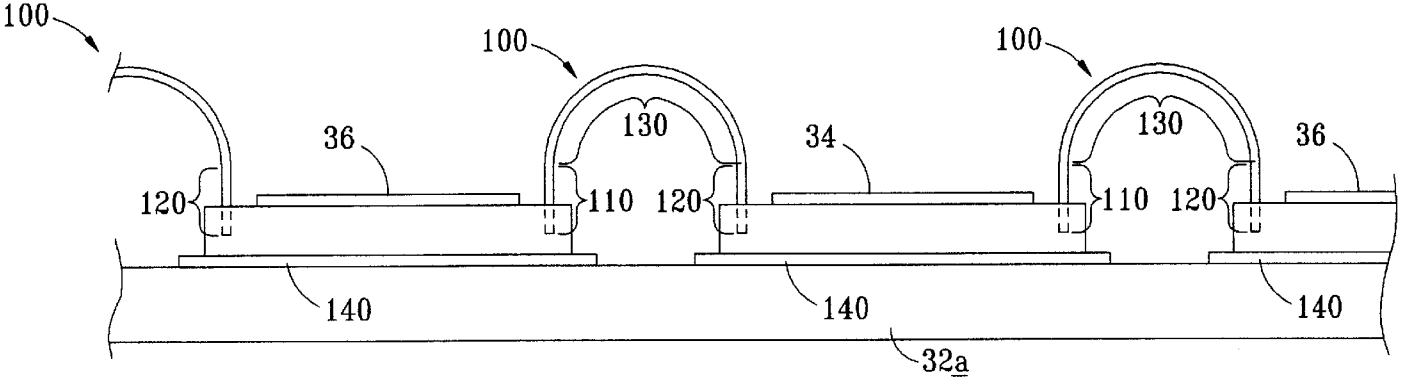
FIG. 7 is a side view of the neutralizers of FIG. 6 illustrating coupling neutralizers attached to adjacent patch antennas.

Referring to FIGS. 6 and 7, there is illustrated a second embodiment of the present invention where the mutual coupling neutralizer 100 is implemented as a conductor. The coupling neutralizer 100 has the same elements, the first capacitor 110, the second capacitor 120 and the high impedance transmission line 130 as described in FIGS. 4 and 5; however, the conductor is utilized rather than the insulated mounting base 150. The conductor of the mutual coupling neutralizer 100 is sized and configured to form an arc substantially perpendicular to the patch antennas 34 and 36.

Also illustrated is a shim 140 located under the patch antennas 34 and 36. The shim 140 functions to adjust the frequency of a patch antenna 34 or 36 back to band center after the connection of the coupling neutralizer 100. The shim 140 is typically required when the coupling neutralizer 100 has been installed in an existing cellular antenna 24, where the antenna 24 was originally sized to have a specific band center.

Figure 8:
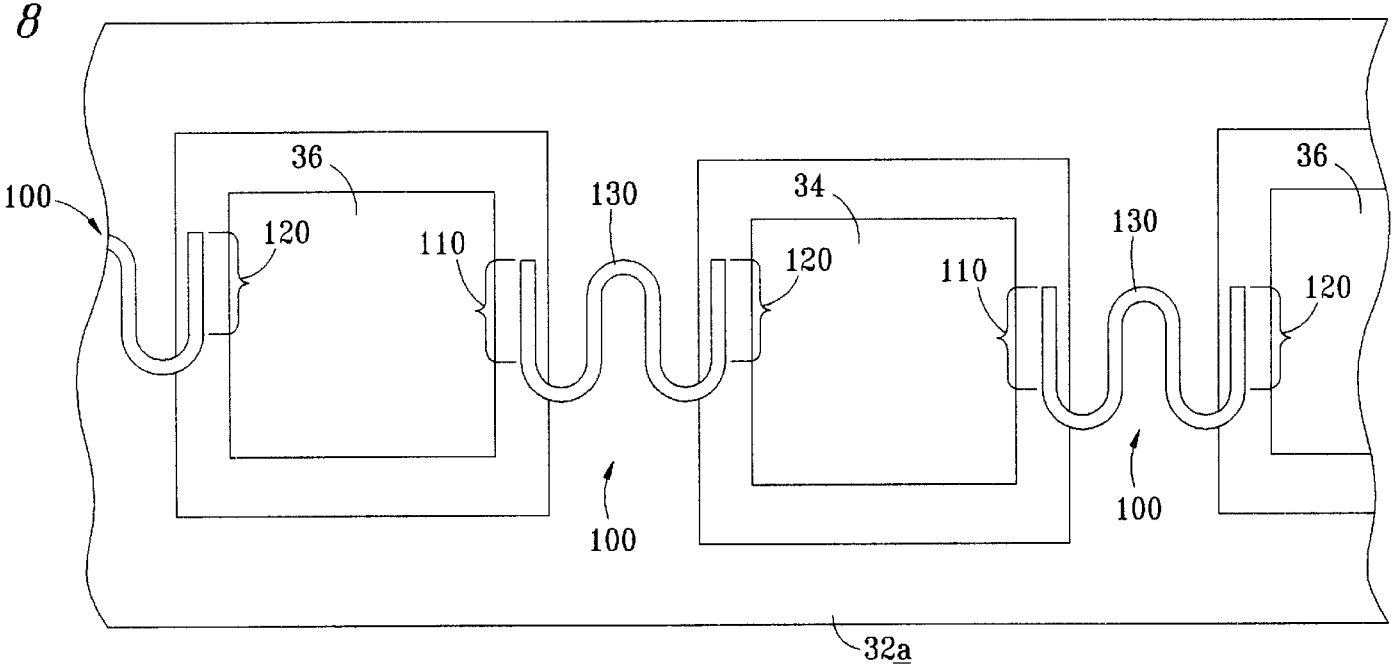
FIG. 8 is a top view of mutual coupling neutralizers incorporated into conductors that are substantially parallel to adjacent patch antennas.
Figure 9:
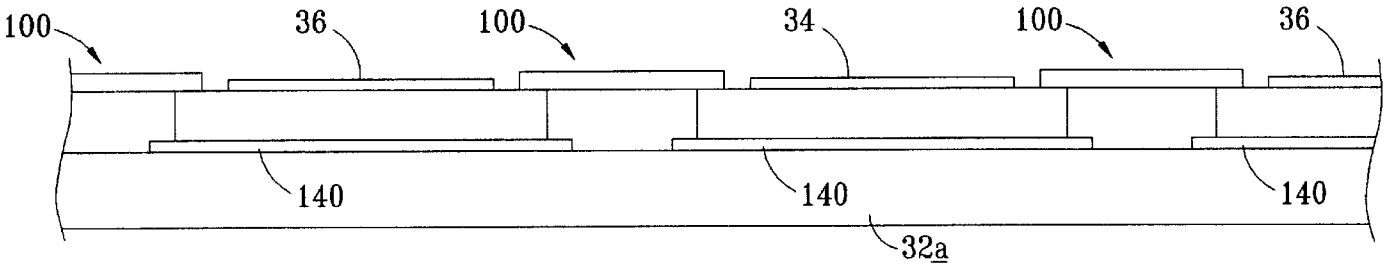
FIG. 9 is a side view of the coupling neutralizers of FIG. 8 illustrating coupling neutralizers attached to adjacent patch antennas.

Referring to FIGS. 8 and 9, there is illustrated a third embodiment of the mutual coupling neutralizer 100 also in the form, a conductor. The coupling neutralizer 100 has the same elements, the first capacitor 110, the second capacitor 120 and the transmission line 130 as described in FIGS. 6 and 7. However, the conductor of the coupling neutralizer 100 is sized and configured to be installed substantially parallel to the patch antennas 34 and 36.

Figure 10A:
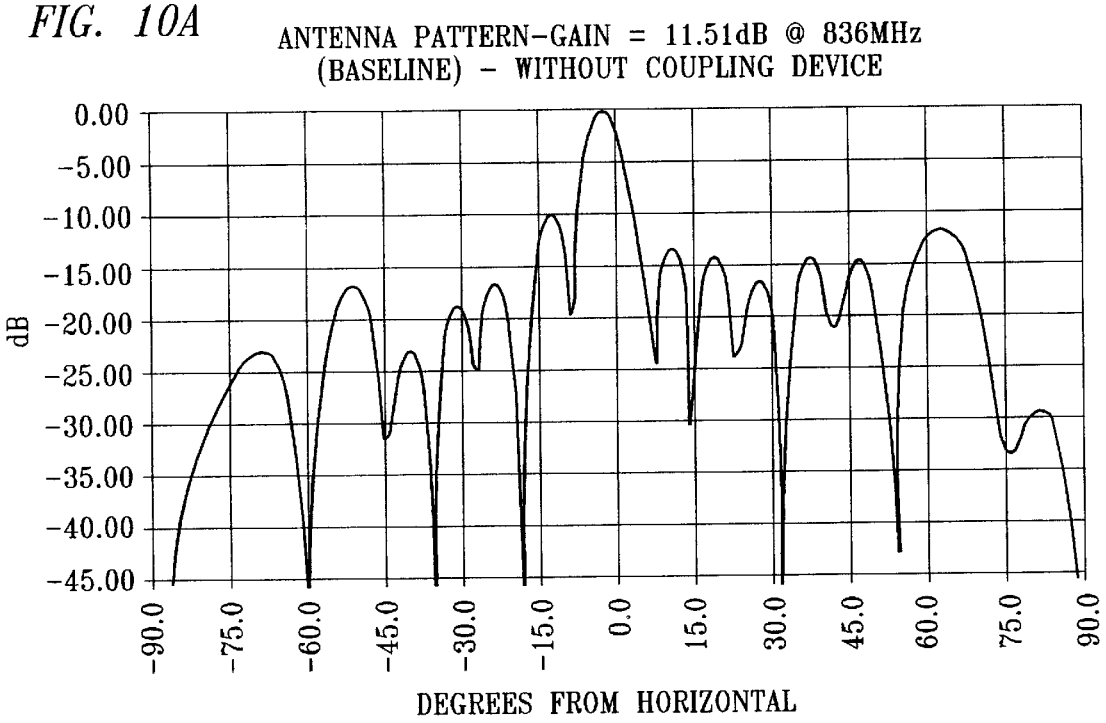
FIGS. 10A and 10B are graphs illustrating the power radiation curves of an antenna receiving horizontal signals at 836 MHz with and without a mutual coupling neutralizer.
Figure 10B:
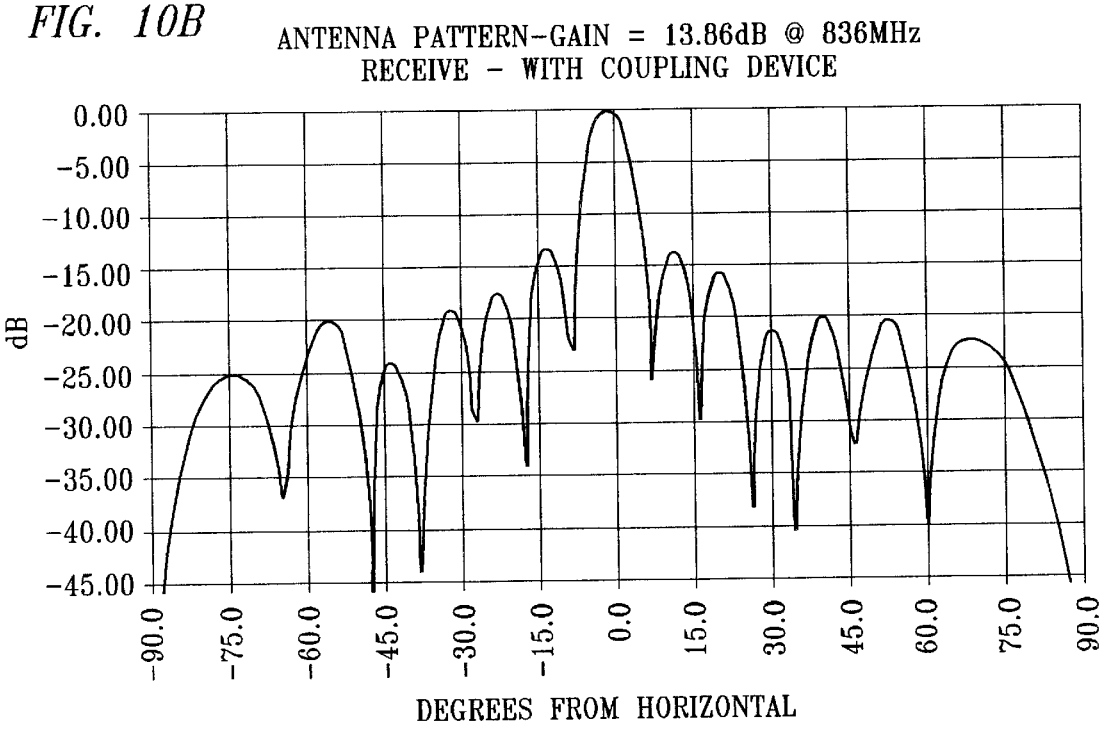

Referring to FIGS. 11A and 10B, the graphs illustrate the power radiation curves of an antenna 24 receiving horizontal signals at 836 MHz with and without the mutual coupling neutralizer 100. The graph in FIG. 10A is a baseline plot of decibels vs Degrees from Horizontal depicting a main beam or gain of an antenna 24 without the coupling neutralizer 100. The main beam was measured at 11.51 db at zero degrees from horizontal. Grating lobes are beams located on either side of the main beam.

The graph in FIG. 10B had a main beam or gain of 13.86 db measured under substantially the same conditions that enabled computing the graph of FIG. 10A. In FIG. 10B the mutual coupling neutralizer 100 was installed between adjacent pair of patch antennas. The coupling neutralizers 100 where implemented on the insulated mounting base 150. Also, the grating lobes of FIG. 10B are smaller than the grating lobes of FIG. 10A thereby indicating an increase in performance of the antenna 24.

Figure 11:
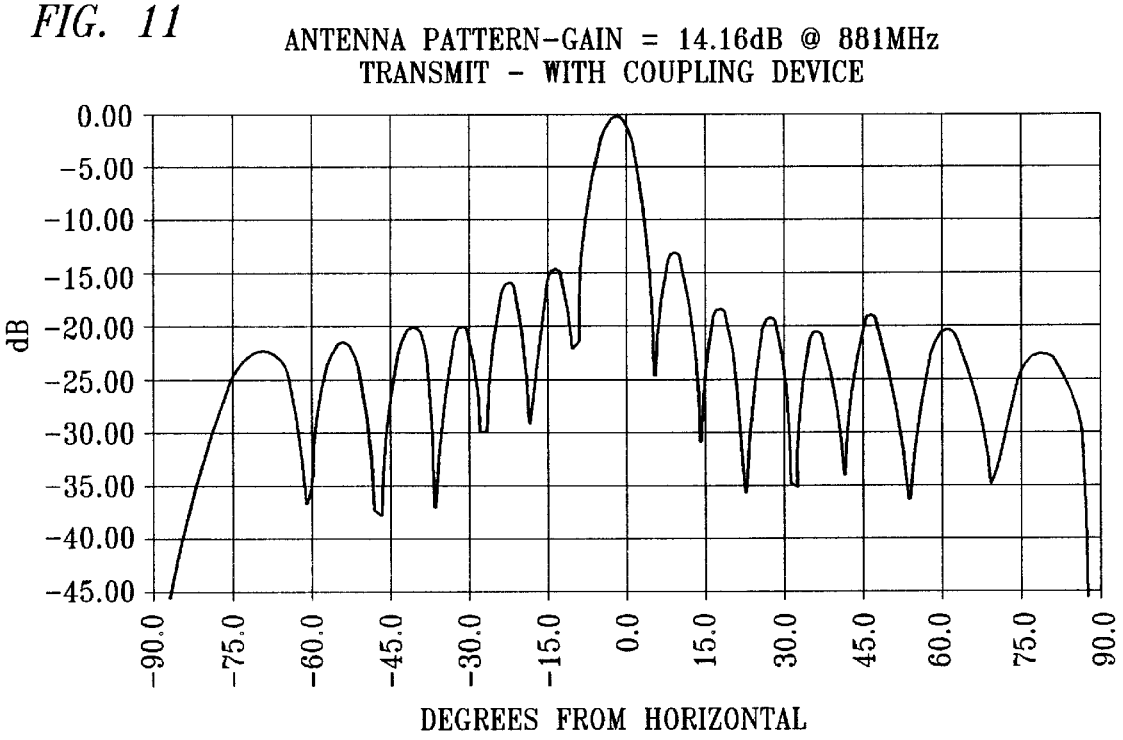
FIG. 11 is a graph illustrating a power radiation curve of an antenna transmitting signals at 881 MHz with a mutual coupling neutralizer.

Referring to FIG. 11, the illustration is of a power radiation curve of an antenna transmitting signals at 881 MHz with a mutual coupling neutralizer between adjacent pairs of patch antennas. The graph indicates an antenna 24 with a gain of 14.16 db with mutual coupling neutralizers 100 installed. The coupling neutralizers 100 were implemented with insulated mounting bases 150 when measuring the gain indicated by the graph.

While the present invention has been described with reference to the illustrated embodiments, it is not intended to limit the invention but, on the contrary, it is intended to cover such alternatives, modifications and equivalents as may be included in the spirit and scope of the invention as defined in the following claims.

We claim:

1. A mutual coupling low-Q resonant circuit neutralizer for neutralizing coupling between patch antennas of an antenna used in a mobile communication system, comprising:

a first capacitor having a first end and a second end, the first end of the first capacitor directly connected to one patch antenna;

an impedance element having a first end and a second ends the first end of the impedance element connected to the second end of the first capacitor;

a second capacitor having a first end and a second end, the first end of the second capacitor directly connected to the second end of the impedance element and the second end of the second capacitor connected to a second patch antenna; and wherein the dimensions of the impedance element and the dimensions of the first and second capacitors combine to form a low-Q circuit configuration to neutralize adverse mutual coupling.

2. The mutual coupling neutralizer in accordance with claim 1 further comprising at least one shim located under each of the patch antennas of the pair, to adjust the frequency of the patch antennas to band center.

3. The mutual coupling neutralizer in accordance with claim 1 further comprising an insulated mounting base supporting etched foil patterns of the transmission line and the first and second capacitors.

4. The mutual coupling neutralizer in accordance with claim 1 wherein the first and second capacitors and the transmission line comprise integral components of a conductor interconnecting the pair of patch antennas.

5. The mutual coupling neutralizer in accordance with claim 4 wherein the conductor comprises an arc mounted substantially perpendicular to the pair of patch antennas.

6. The mutual coupling neutralizer in accordance with claim 4 further comprising an antenna panel, and means for mounting the conductor and the pair of patch antennas substantially parallel to the antenna panel.

7. The mutual coupling neutralizer in accordance with claim 1 wherein the pair of patch antenna elements comprises a receiving antenna and a transmitting antenna and further comprising means for mounting the transmission line and first and second capacitors between adjacent patch antennas.

8. A cellular antenna for a mobile communication system, comprising:

at least one antenna panel having formed thereon a first, linear array of a plurality of patch antennas for receiving signals and a second linear array of a plurality of patch antennas, interleaved with the elements of the first array, for transmitting signals; and a plurality of mutual coupling low-Q resonant circuit neutralizers individually connected between a transmitting patch antenna and a receiving patch antenna.

9. The cellular antenna in accordance with claim 8 further comprising a radome enclosing the at least one antenna panel.

10. The cellular antenna in accordance with claim 8 further comprising a mounting plate for attaching the radome to a supporting surface, and a plurality of connectors extending through the mounting plate for electrical connection to each of the at least one antenna panel.

11. The cellular antenna in accordance with claim 8 further comprising means for coupling the cellular antenna to a base station of the mobile communication system.

12. A method for neutralizing coupling between a transmitting patch antenna and a receiving patch antenna, comprising the steps of:

extracting a signal present at the transmitting patch antenna;

transmitting the extracted signal through a low-Q resonant circuit; and injecting the extracted signal at the receiving patch antenna at an amplitude substantially equal to the amplitude of the extracted signal and opposite in phase from the extracted signal.

13. A communication system comprising:

a receiving patch antenna;

a transmitting patch antenna; and a low-Q resonant circuit means for neutralizing coupling between the receiving patch antenna and the transmitting patch antenna, the low-Q resonant circuit means comprising:

a first capacitor having a first end and a second end, the first end connected to the receiving patch antenna;

an impedance element having a first end and a second end, the first end connected to the second end of the first capacitor;

a second capacitor having a first end and a second end, the first end connected to the second end of the impedance element and the second end connected to the transmitting patch antenna; and wherein the dimensions of the impedance element and the dimensions of the first and second capacitors combine to form a low-Q circuit configuration to neutralize adverse mutual coupling.

* * * * *

UNITED STATES PATENT AND TRADEMARK OFFICE

CERTIFICATE OF CORRECTION

PATENT NO. : 5,892,482
DATED : April 6, 1999
INVENTOR(S) : William E. Coleman, Jr., et al.

It is certified that error appears in the above-identified patent and that said Letters Patent is hereby corrected as shown below:

Column 5, line 9, after "Figs.", delete "11A", and insert --10A--.

Column 5, line 48, delete "ends", and insert --end,--.

Signed and Sealed this

Twenty-eighth Day of March, 2000

*Attest:*

Q. TODD DICKINSON

*Attesting Officer*

*Commissioner of Patents and Trademarks*